United States Patent [19]

Takimae

[11] Patent Number: 4,819,674

[45] Date of Patent: Apr. 11, 1989

[54] CURLY HAIR CORRECTING IRON

[76] Inventor: Toyosaku Takimae, 2-26, 2-chome, Takanawa, Minato-ku, Tokyo, Japan

[21] Appl. No.: 21,871

[22] Filed: Mar. 4, 1987

[30] Foreign Application Priority Data

Dec. 26, 1986 [JP] Japan ..... 61-308764

[51] Int. Cl.[4] ..... A45D 2/40

[52] U.S. Cl. ..... 132/224; 219/225

[58] Field of Search ..... 132/31 R, 32 R, 34 R, 132/46 R, 48 R, 37 R, 117, 118; 219/222, 225, 226, 230

[56] References Cited

U.S. PATENT DOCUMENTS

| | | | |
|---|---|---|---|
| 853,349 | 5/1907 | Fields | 132/32 R |
| 1,465,838 | 8/1923 | Caneavri | 132/32 R |
| 1,572,161 | 2/1926 | Russell | 132/32 R |
| 1,593,055 | 7/1926 | Arnole | 132/31 R |
| 1,605,540 | 11/1926 | Gibney | 132/32 R |
| 1,642,888 | 9/1927 | Perry | 132/31 R |
| 1,694,672 | 12/1928 | Rogler | 219/225 |
| 1,793,061 | 2/1931 | Cocroft | 132/32 R |
| 4,029,110 | 6/1977 | Hyland | 219/225 |
| 4,209,685 | 6/1980 | Walter et al. | 132/32 R |
| 4,242,567 | 12/1980 | Carter | 132/32 R |
| 4,464,562 | 8/1984 | Takimae | 132/32 R |
| 4,479,047 | 10/1984 | Khaja et al. | 219/230 |
| 4,549,560 | 10/1985 | Andis | 219/222 |
| 4,602,143 | 7/1986 | Mack et al. | 219/230 |
| 4,739,151 | 4/1988 | Smal | 132/32 R |

FOREIGN PATENT DOCUMENTS

| | | | |
|---|---|---|---|
| 2281735 | 3/1976 | France | 132/32 R |
| 2310105 | 12/1976 | France | 219/225 |

*Primary Examiner*—Gene Mancene
*Assistant Examiner*—Michael Lynch
*Attorney, Agent, or Firm*—Armstrong, Nikaido Marmelstein & Kubovcik

[57] ABSTRACT

This invention relates to a curly hair correcting iron for correcting natural curly hair into straight hair. The iron comprises two rods containing therein heaters, respectively, one rod having its surface provided with two spaced rows of projections which are triangular or semicircular in section, the other rod having its surface likewise provided with a row of projections which also are triangular or semicircular in section so as to be positioned between the two rows of projections on the first rod, whereby when hair is sandwiched therebetween it is curved into a U-shape or a V-shape. The hair is held and pulled in the direction of the hair end thereby exerting strong drawing, heat and tension on the hair to extend it. To dampen pressure, it is preferable that a resilient layer be pasted onto the rod surface, and to dampen the action of heat to enhance the efficiency, it is desirable that the resilient layer be formed of a material having a far infrared radiation.

4 Claims, 2 Drawing Sheets

CURLY HAIR CORRECTING IRON

BACKGROUND OF THE INVENTION 1. Field of the Invention

This invention relates to a curly hair correcting iron for correcting natural curly hair into a straight hair.

2. Description of the Prior Art

There are people who have natural curly hair, and some of these people desire to correct curly hair into a straight hair. Heretofore, to correct natural curly hair so-called a natural permanent wave into a straight hair, it is carried out by fixing the stretched state of curly hair under the same principle as in the case where hair is pulled so as to draw or squeeze the hair with a heated iron using a permanent liquid to form a wave.

The shape of the iron used for the object as described above include, as shown in section of FIG. 4, (a) two heated rods 9, (b) rubber 10 is pasted on the inner surface of one of the flat rods 9, (c) one of the flat rods 9 is formed into a triangular rod 11, and pressure is concentrated on one of apexes thereof, and (d) heating rods 12 are both formed into rotatable round rods, between which hair is wound and drawn out.

The aforesaid iron poses problems in that the iron has a weak force to stretch curly hair so that it takes time to provide a straight hair, and that even if the hair is once stretched, it again returns to its original curly hair when shampoo is applied. This results, for example, from the fact that in types (a) and (b), the stretching force applied to hair one by one is weak, and in type (c), pressure is merely applied from one side of hair, and if stretching pressure is increased, hair tends to be damaged. Further, in type (d), the stretching force is weak.

SUMMARY OF THE INVENTION

It is an object of this invention to provide a curly hair correcting iron which can provide strong pressure to hair, gives no damage to hair even by strong stretching force, and is free from returning to curly hair due to shampooing or the like.

According to the basic construction of an iron of this invention, as shown in FIG. 2 which shows a cross section of the rods, the iron comprises two rods containing heaters therein, one rod having a surface provided with spaced two projections which have triangular or semicircular cross-section, the other rod having a surface likewise provided with projection which have triangular or semicircular cross-section so as to be positioned between said two projections, whereby when hair is held therebetween, the hair is curved into U-shape or V-shape.

When curly hair is firmly held and pulled by the iron constructed as described above, hair is first brought into contact with the iron by the three projections, and the hair is curved into U-shape or V-shape while being fixed at said contact points thereby enabling to receive strong stretching action. In that state, when the iron is pulled, the hair undergoes strong pressure by the top ends of the projections from both sides, and the hair is alternately bent in the opposite direction, first downward, next upward and then downward as viewed from FIG. 2, thus receiving a strong stretching action. Further, since the hair is firmly gripped by the iron due to said bending, the thus stretched hair portion receives a tension when it moves out of the iron, and the hair is cooled and fixed while being extended.

DETAILED DESCRIPTION OF THE PREFERRED EMBODIMENT

Figure 1:
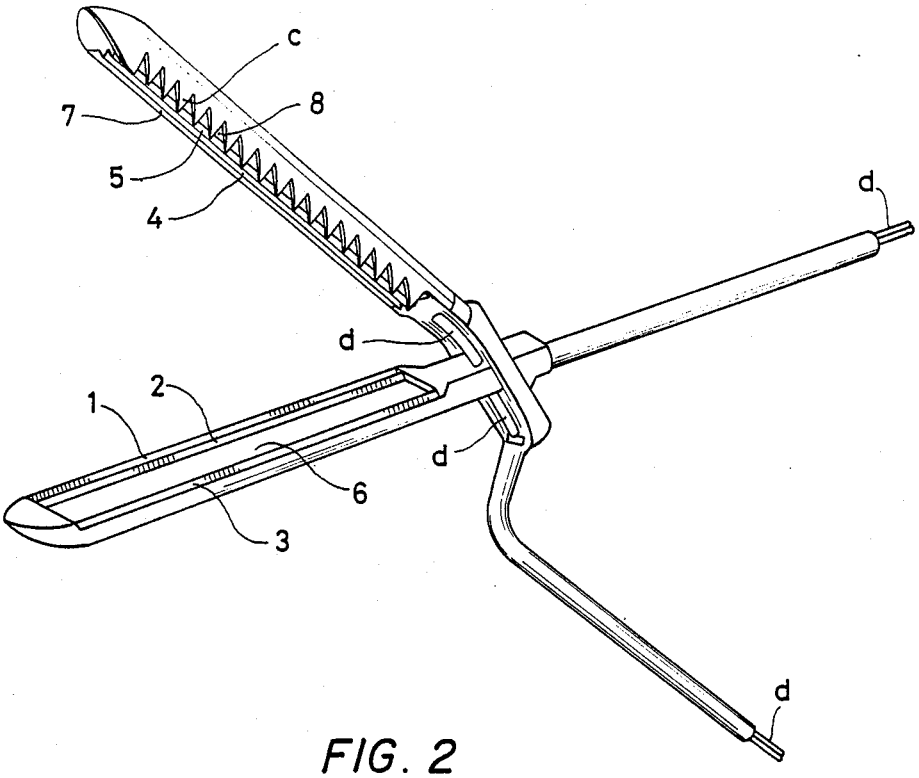
FIG. 1 is a perspective view showing the entire iron according to this invention.
Figure 2:
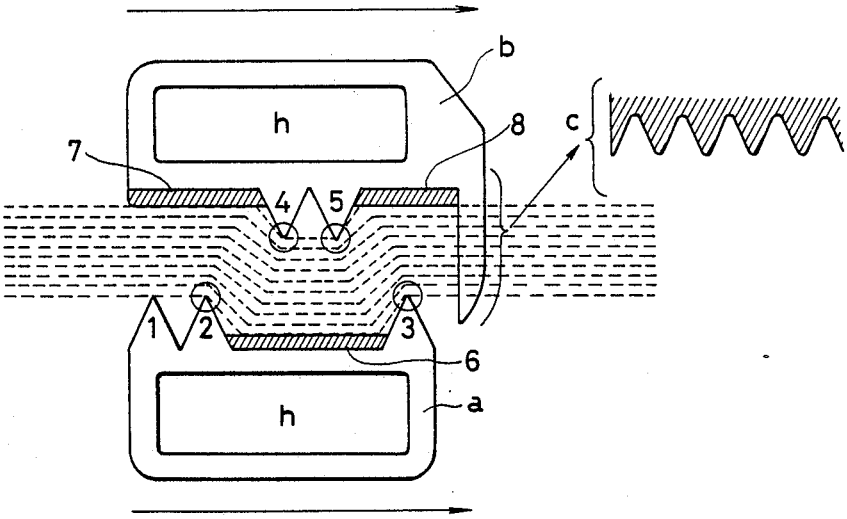
FIG. 2 is a sectional view of a rod portion.
Figure 3A:
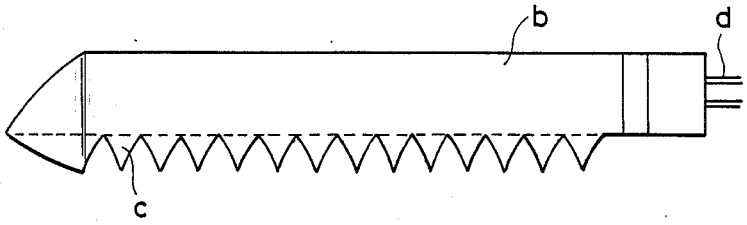
FIGS. 3(*a*) to (*d*) are respectively plan views and side views of the rods.
Figure 3B:
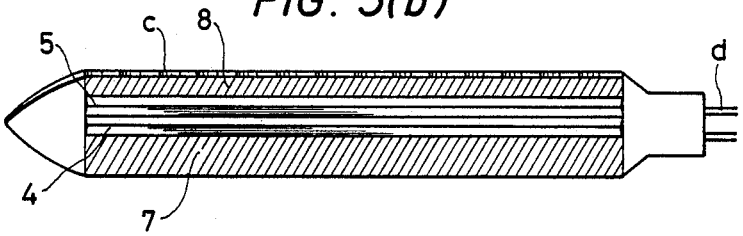
Figure 3C:
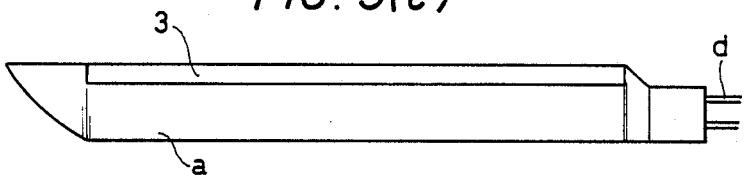
Figure 3D:
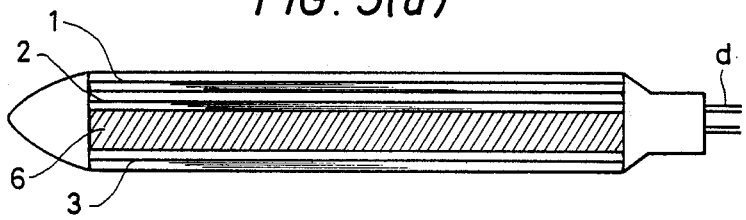
Figure 4A:
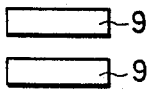
PRIOR ART FIG. 4(a)
FIG. 4 is a sectional view showing the shape of rod of a conventional iron.
Figure 4B:
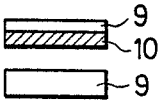
PRIOR ART FIG. 4(b)
Figure 4C:
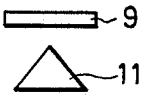
PRIOR ART FIG. 4(c)
Figure 4D:
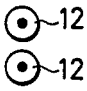
PRIOR ART FIG. 4(d)

The embodiment of this invention will be described hereinafter with reference to the drawings, in which FIG. 1 is a perspective view of the entire iron, FIG. 2 is a sectional view of a rod portion, and FIGS. 3(*a*) to (*d*) are respectively plan views and side views. The overall structure is in the form of scissors having two rods a and b containing therein heaters h, respectively, as is known.

A rod a is provided with projections 1, 2 and 3 along the opposite sides thereof. The shape of the projections can be triangular, semicircular, etc. in cross section, at the end of which pressure may be concentrated. A trapezoid can be employed, in which case, the width of the top surface thereof is less than 1 milimeter, and it is desirable to be substantially close to a triangular shape.

A rod b is provided at its central portion with projections 4 and 5 and at its end with a comb portion c.

When curly hair provided with a first permanent-wave liquid is held by the iron and pulled in the direction along the arrow, curly hair entwined each other is combed by the comb portion c and introduced in parallel between the rods. Then, the hair is bent and drawn up and down while being heated by the projections, and side chains of hair componets are cut. Even moved out of the iron, the hair bent and held thereon receives a sufficient slide resistance so that a strong tension occurs on the stretched portion thereof, which is cooled while maintaining the form of straight hair. Then, this is fixed by a second permanent-wave liquid.

Preferably, cushion layers 6, 7 and 8 of resilient plastic having a heat resistance such as teflon, silicon, polyamide family are provided on a rod surface portion with which the projection of the other rod contacts. These plastic layers dampen a point pressure at the top end of the projection due to the resilient force thereof. Moreover, even if engagement of the iron is somewhat deviated due to the resiliency, the cusion layers may absorb such deviation and apply an average pressure to the hair, which action leads to an advantage that minimizes breakage or damage of hair.

Furthermore, preferably, far infrared radiation having wavelength of 5 to 10 microns is provided from the rod surface, particularly the neighborhood of the end of the projection. It is known that the far infrared radiation is resonance absorbed by hair to thereby provide a sufficient heating effect at a low temperature and even heating of the inside of the hair due to its permeability, and where the far infrared radiation is applied to the hair iron, denaturation of hair at a high temperature is prevented and the effect of ironing can be extended. In the case where the far infrared radiation is needed for the iron according to this invention, the effect of the far infrared ray may be obtained by the methods such that far infrared radiation material of alumina, zircon or zircon and magnetite family is coated on the surface of each projection, or it is mixed into plastics of cushion layers.

While in the illustrated embodiment, the numbers of the projections 1, 2 of the rod a and the projections 4, 5 of the rod b are two respectively, it is to be noted that the number of projections may be changed into one or three, for example, and that the width of the rod may be increased to the number of the so that hair may be bent into W-shape. In this way, designs may be variously changed. Reference character d designates an electric cord.

According to the iron of this invention, as described above, curly hair may be given alternate opposite stretching while being applied strong pressure thereto and sufficient tension may be caused, and the curly hair may be extended into a straight hair and fixed. In addition, pressurized points may be dispersed to minimize the damage to hair. The hair formed into a straight hair by the present iron is not returned to its original state even if shampoo is applied, thus obtaining the longer effect that had not been attained by a conventional iron.

What is claimed is:

1. A hair straightening iron comprising a first and second rod each having a heater therein and a substantially planar inner surface, said first and second rods being connected at one end thereof with said planar inner surfaces being each other in a manner such that a plurality of curly hairs can be held therebetween laterally to said first and second rod, said first rod having at least one row of continuous projections, each projection extending longitudinally with a substantially uniform height along said first rod substantially along the central axis of said planar inner surface, at least a pair of first planar heat-resistant cushion layers being provided upon said planar inner surface at both sides of said at least one row of continuous projections, and second rod having at least two spaced projections, each of said projections extending longitudinally with a substantially uniform height along said second rod and each being located substantially spaced from said at least one row of continuous projections and at least a second planar heat-resistant cushion layer being provided upon said planar inner surface of said second rod positioned between said two spaced projections, wherein each of said first and second planar heat-resistant cushion layers has a substantial width such that hairs held therebetween can be straightened.

2. A hair straightening iron according to claim 1, wherein said heat-resistant cushion layer is made of a material having a far infrared radiation function.

3. A hair straightening iron to claim 1, wherein said first rod further having a comb longituinally at one side end thereof.

4. A hair straightening iron to claim 1, wherein each said projection has substantially a triangular cross-section.

* * * * *